US008371707B2

(12) United States Patent
Uzar

(10) Patent No.: US 8,371,707 B2
(45) Date of Patent: Feb. 12, 2013

(54) PORTABLE LIGHT SOURCE

(76) Inventor: Robert Timothy Uzar, Newnan, GA (US)

( * ) Notice: Subject to any disclaimer, the term of this patent is extended or adjusted under 35 U.S.C. 154(b) by 284 days.

(21) Appl. No.: 12/477,614

(22) Filed: Jun. 3, 2009

(65) Prior Publication Data

US 2010/0309651 A1 Dec. 9, 2010

(51) Int. Cl.
*F21V 21/084* (2006.01)

(52) U.S. Cl. ..... 362/105; 362/106; 362/107

(58) Field of Classification Search ..... 362/105–107
See application file for complete search history.

(56) References Cited

U.S. PATENT DOCUMENTS

| | | | | |
|---|---|---|---|---|
| 4,521,831 | A * | 6/1985 | Thayer | 362/106 |
| 6,616,294 | B1 * | 9/2003 | Henry | 362/106 |
| 7,549,763 | B2 * | 6/2009 | Kim et al. | 362/106 |
| 2008/0237422 | A1 * | 10/2008 | Dalton | 248/229.1 |

* cited by examiner

*Primary Examiner* — William Carter
(74) *Attorney, Agent, or Firm* — Laurence P. Colton; Smith Risley Tempel Santos LLC

(57) ABSTRACT

A portable light source for connection to a hardhat. The portable light source has a battery housing with an LED light mounted in a swivel portion that is connected to the battery housing. The housing also has a mounting post that engages an aperture on the side of the hardhat for holding the portable light source in place.

11 Claims, 3 Drawing Sheets

PORTABLE LIGHT SOURCE

FIELD OF THE INVENTION

This invention relates to a portable light source that can be mounted on a hardhat.

BACKGROUND OF THE INVENTION

In an environment in which a worker is required to wear a hardhat, there may also exists a need for supplemental lighting to assist the worker in completing a task or inspecting work product. A conventional handheld flashlight commonly used in such situations occupies the use of one hand of the worker, leaving only one hand free to perform the required tasks. Alternatively, a second helper may be required simply to hold the flashlight while work is being accomplished. In order to free up both hands, a headlamp attached to a headband may be used to provide supplemental lighting to assist the worker in the task at hand. Such a headlamp with a headband may preclude the wearing of a hardhat. Also, a headlamp with a set of straps specifically designed for a hardhat may be strapped to the worker's hardhat in order to free up both of the workers hands. Such a headlamp with a set of straps may be cumbersome, expensive, and difficult to use.

SUMMARY OF THE INVENTION

The present invention addresses the difficulties encountered when a worker, required to wear a hardhat, must have supplemental light in order to perform an assigned task that requires both hands. Particularly, the present invention is a compact, lightweight, portable light source that clips into one or both side apertures on a conventional hardhat. The portable light source includes a housing for containing a battery, a lamp holder rotatably connected to the housing and containing a lamp, preferably a light emitting diode (LED), and a mounting post attached to the housing for engaging a side aperture of the hardhat. The portable light source further includes necessary wiring between the battery and the LED, as well as an interconnected switch to connect and disconnect the battery to and from the LED.

The side aperture on both sides of the conventional hardhat typically serves as a mounting mechanism for a facemask or for ear protection. The mounting post of the portable light source is configured and dimensioned to fit into the side aperture on either side of the hardhat. In addition, the mounting post includes a resilient clip that flexes as the mounting post is inserted into the side aperture and engages the side aperture once the mounting post has been completely inserted into the side aperture to hold the portable light source firmly in place within the side aperture.

Because the lamp holder of the portable light source can rotate approximately 360° with respect to the housing, the portable light source can be fitted to either side of the hardhat with the LED facing forward or two portable light sources can be fitted to both sides of the hardhat with both LEDs facing forward. With two portable light sources mounted on each side of the hardhat, the hardhat is balanced, and the light from the two portable light sources is spread over a broader field of vision. Further, rotating the lamp holder with respect to the housing, allows the LED to be aimed to provide optimum lighting.

Further objects, features and advantages will become apparent upon consideration of the following detailed description of the invention when taken in conjunction with the drawings and the appended claims.

DETAILED DESCRIPTION OF THE EMBODIMENTS OF THE INVENTION

Figure 1:
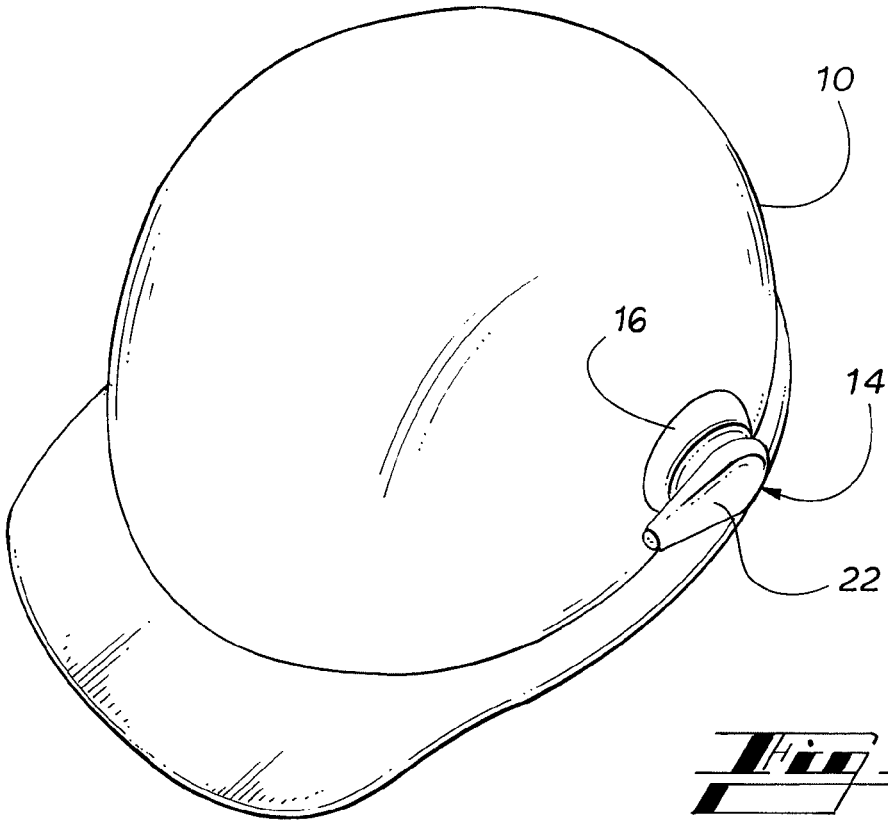
FIG. 1 is a front perspective view of the portable light source attached to a conventional hardhat in accordance with the present invention.
Figure 2:
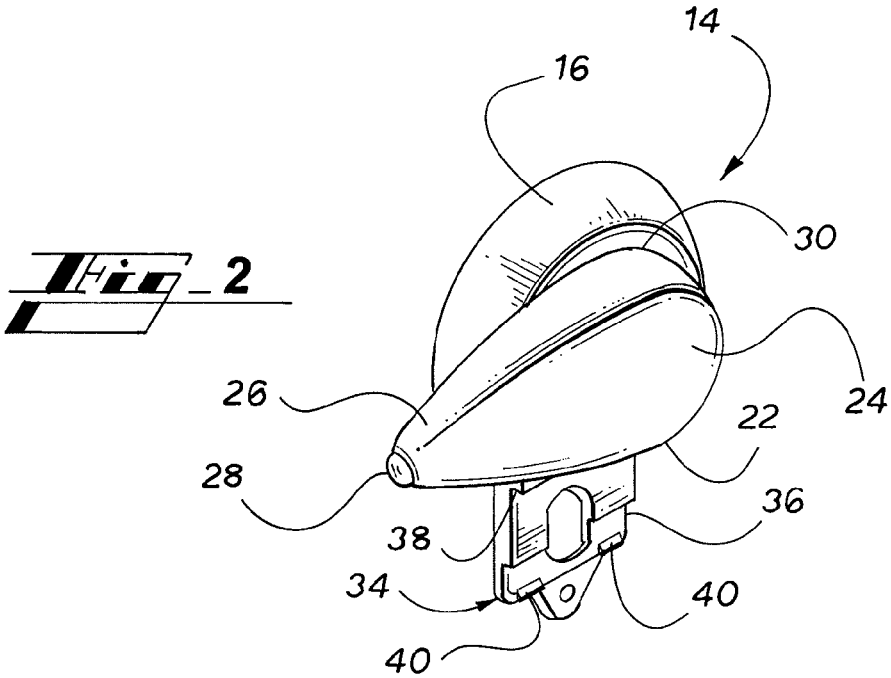
FIG. 2 is a front perspective view of the portable light source in accordance with the present invention.
Figure 3:
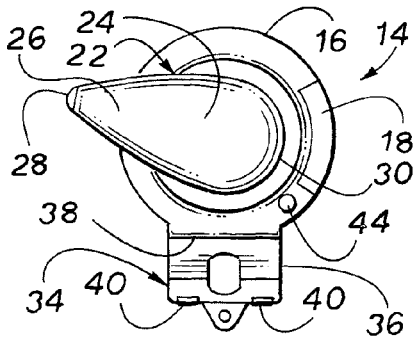
FIG. 3 is a side elevation view of the portable light source in accordance with the present invention.
Figure 6:
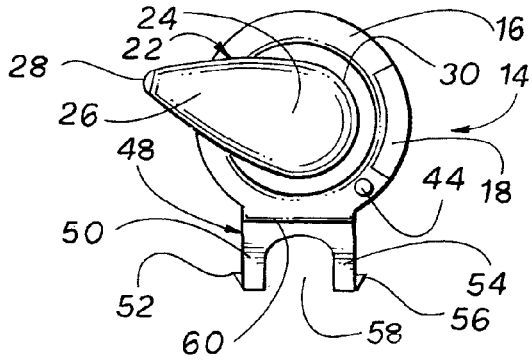
FIG. 6 is a side elevation view of a second embodiment of the portable light source in accordance with the present invention.
Figure 4:
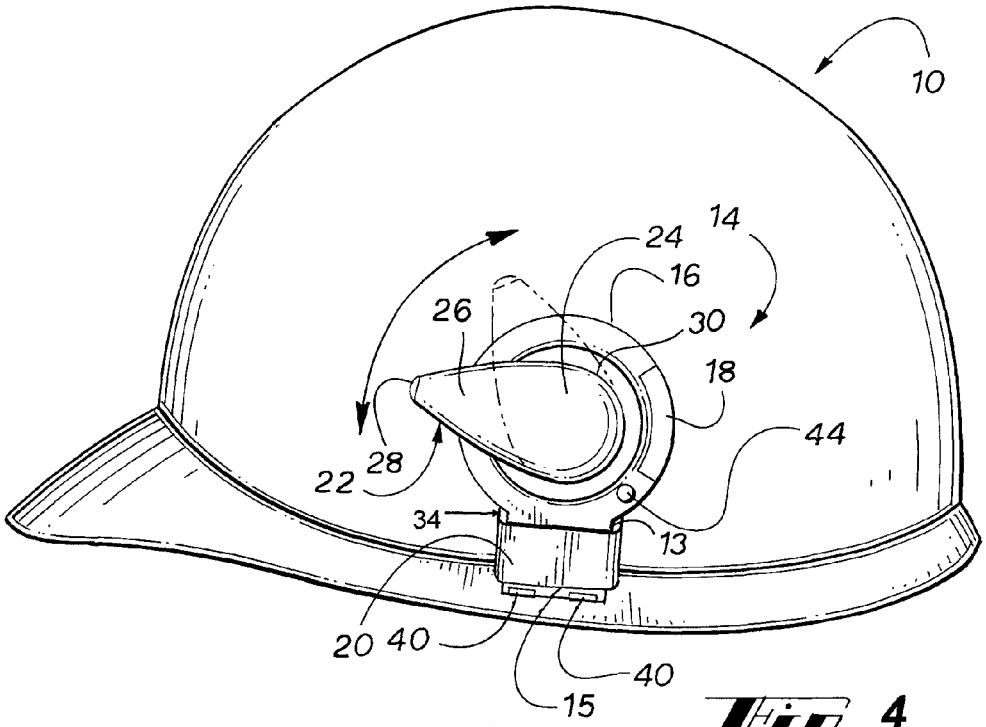
FIG. 4 is a side elevation view of the portable light source attached to a conventional hardhat in accordance with the present invention.
Figure 5:
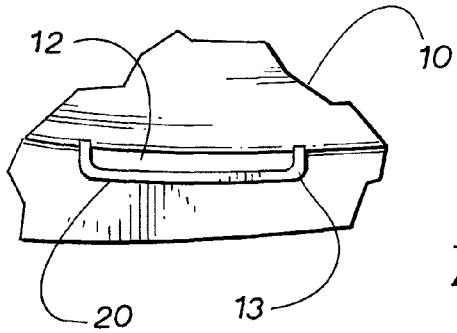
FIG. 5 is a top plan detailed view of the side aperture of the hardhat shown in FIGS. 1 and 5.

FIGS. 1 and 3 show a portable light source 14 constructed in accordance with the present invention. FIGS. 2 and 4 show the portable light source 14, in accordance with the present invention, attached to a conventional hardhat 10. FIG. 6 shows a second embodiment of the portable light source 14.

Figure 7:
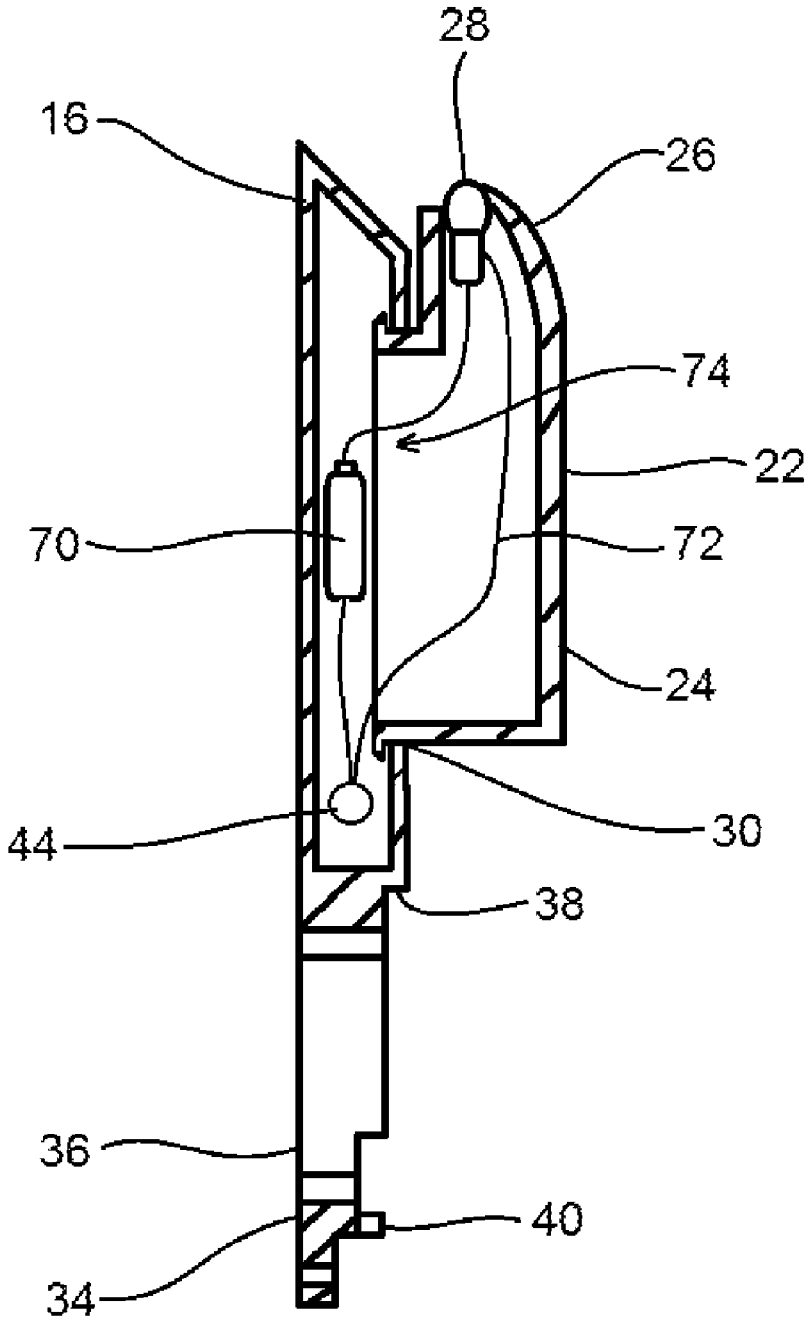
FIG. 7 is a side cross sectional view of the portable light source as shown in FIG. 3 generally along a vertical plane extending into the page in accordance with the present invention.

Turning to FIGS. 1, 3, and 7, the portable light source 14 comprises a housing 16, a lamp holder 22, and a mounting post 34. The housing 16 is generally round or oval in shape and is generally hollow to accommodate a battery compartment covered by an access panel 18 and a battery 70 within the battery compartment. An electric switch 44 is mounted on the housing 16. The mounting post 34 is fixed to the bottom of the housing 16 and extends from the housing 16. The lamp holder 22 is rotatably connected to the housing by means of a pivot joint 30.

The lamp holder 22 comprises a generally hollow body 24 and generally hollow extension 26. A light emitting diode (LED) 28 is mounted within the extension 26. The pivot joint 30, which rotatably connects the body 24 of the lamp holder 22 to the housing 16, includes an opening 74 between the hollow housing 16 and the hollow lamp holder 22 to accommodate wires 72 from the battery 70 in the hollow housing 16 to the LED in the lamp holder 22. Alternatively, the battery 70 could be mounted within hollow body 24 of the lamp holder 22 thereby eliminating the need for an opening 74 between the housing 16 and the lamp holder 22. The pivot joint 30 is configured so that sufficient friction exists between the body 24 of the lamp holder 22 and the housing 16 so that the lamp holder 22 can be rotated to any particular position within a 360° arc, and the friction in the pivot joint 30 will retain the lamp holder 22 in that relative orientation to the housing 16.

As will be appreciated by those of ordinary skill in the art, wires 72 connect the LED 28 to the battery 70 in the compartment covered by access panel 18 through the switch 44.

The mounting post 34 is configured and dimensioned to fit into a side aperture 12 of the hardhat 10. The side aperture 12, shown in FIGS. 4 and. 5, is created by loop member 20, with a top and bottom opening, molded into the side of the hardhat 10. The side aperture 12 is located on each side of the hardhat 10 just above the ear of the wearer. The mounting post 34 shown in FIGS. 2 and 3 comprises a stop 38 at the proximal end of the mounting post 34 and a clip fastener 32. The clip fastener 32 comprises a resilient leg 36 extending from the stop 38, and keepers/cams 40 located at the distal end of the mounting post 34.

In use, the mounting post 34 is inserted into the side aperture 12 of the hardhat 10. The keepers/cams 40 engage the inside of the side aperture 12, and the resilient leg 36 is forced inwardly toward the hardhat 10 by the camming action of the keepers/cams 40 so that the mounting post 34 can slide into the side aperture 12. Once the mounting post 34 is fully inserted into the side aperture 12 and the stop 38 has engaged the top 13 of the loop member 20 of the side aperture 12, the keepers/cams 40 clear the bottom 15 of the loop member 20 of the side aperture 12. Once the keepers/cams 40 clear the bottom 15 of the loop member 20 of the side aperture 12, the keepers/cams 40 engage the bottom 15 of the loop member 20 of the side aperture 12 and hold the mounting post 34 within the side aperture 12. In that manner, the portable light source 14, secured within the side aperture 12, is securely mounted to the hardhat 10.

In an alternative embodiment, a mounting post 48 has a stop 60 at its proximal end a clip fastener 62. The clip fastener 62 comprises two downwardly extending resilient legs 50 and 54 separated by a split 58. Each leg has a keeper/cam 52 and a keeper/cam 56 respectively at its distal end. The resilient legs 50 and 54 are compressed together by the camming action of the keepers/cams 52 and 56 when the mounting post 48 is inserted into the loop member 20 of the side aperture 12. Once the mounting post 48 has been fully inserted into the side aperture 12 and the stop 60 engages the top 13 of the loop member 20 of the side aperture 12, the keepers/cams 52 and 56 are forced outwardly by the resiliency of the legs 50 and 54 and engage the bottom 15 of the loop member 20 of the side aperture 12 of the hardhat 10.

While this invention has been described with reference to preferred embodiments thereof, it is to be understood that variations and modifications can be affected within the spirit and scope of the invention as described herein and as described in the appended claims.

I claim:

1. A portable light source for mounting on a hardhat having a side aperture, the portable light source comprising:

a) a housing holding a battery;

b) a lamp holder, for supporting a lamp, mounted to the housing by a pivot joint, wherein the pivot joint includes an opening between the housing and the lamp holder; and c) a mounting post fixed to the housing and having a resilient clip fastener, wherein wires between the battery and the lamp pass through the opening between the housing and the lamp holder, and wherein the mounting post is configured and dimensioned to fit into the side aperture of the hardhat, and the clip fastener engages the side aperture to secure the portable light source to the hardhat.

2. The portable light source of claim 1, wherein the lamp holder includes a hollow body for holding a battery.

3. The portable light source of claim 1, wherein the mounting post comprises a stop at its proximal end and the clip fastener comprises a resilient leg extending from the stop and a keeper/cam located at the distal end of the mounting post.

4. The portable light source of claim 1, wherein the mounting post comprises a stop at its proximal end and the clip fastener comprises two downwardly extending resilient legs and a keeper/cam respectively at the distal end of each leg.

5. A combination hardhat and light source, comprising:

a) a hardhat having a side aperture; and b) a portable light source for mounting on the hardhat, the portable light source comprising:

i) a housing;

ii) a lamp holder, for supporting a lamp, mounted to the housing by a pivot joint, the pivot joint including an opening between the housing and the lamp holder; and ii) a mounting post fixed to the housing and having a resilient clip fastener, wherein the mounting post is configured and dimensioned to fit into the side aperture of the hardhat, and the clip fastener engages the side aperture to secure the portable light source to the hardhat, and wherein the housing holds a battery, and wires between the battery and the lamp pass through the opening between the housing and the lamp holder.

6. The combination hardhat and light source of claim 5, wherein the side aperture is a loop member having a top and bottom opening molded into a side of the hardhat.

7. The combination hardhat and light source of claim 6, wherein the mounting post comprises a stop at its proximal end and the clip fastener comprises a resilient leg extending from the stop and a keeper/cam located at the distal end of the mounting post.

8. The combination hardhat and light source of claim 6, wherein the mounting post comprises a stop at its proximal end and the clip fastener comprises two downwardly extending resilient legs and a keeper/cam respectively at the distal end of each leg.

9. The combination hardhat and light source of claim 6, wherein the hardhat further comprises two side apertures, and wherein the mounting post is configured and dimensioned to fit into either of the two side apertures of the hardhat.

10. The combination hardhat and light source of claim 9, wherein the pivot joint is configured so that the lamp holder is rotatable to any position within a 360° arc.

11. The combination hardhat and light source of claim 5, wherein the lamp holder includes a hollow body for holding the battery.

* * * * *